United States Patent [19]

Döhlemann

[11] Patent Number: 4,765,388

[45] Date of Patent: Aug. 23, 1988

[54] ROMAN BLIND

[75] Inventor: Günter Döhlemann, Weilheim/Teck, Fed. Rep. of Germany

[73] Assignee: Dofix-Dohlemann GmbH, Fed. Rep. of Germany

[21] Appl. No.: 938,902

[22] Filed: Dec. 8, 1986

Related U.S. Application Data

[63] Continuation of Ser. No. 666,808, Oct. 31, 1984, abandoned.

[30] Foreign Application Priority Data

Nov. 2, 1983 [DE] Fed. Rep. of Germany ..... 8331344

[51] Int. Cl.[4] ..... A47H 5/00

[52] U.S. Cl. ..... 160/84.1; 160/348

[58] Field of Search ..... 160/84 R, 330, 348

[56] References Cited

U.S. PATENT DOCUMENTS 3,948,307 4/1976 Scholer ..... 160/348

3,952,788 4/1976 Scholer ..... 160/348 X

*Primary Examiner*—Robert W. Gibson, Jr.

*Assistant Examiner*—Blair M. Johnson

*Attorney, Agent, or Firm*—Sughrue, Mion, Zinn, Macpeak, and Seas

[57] ABSTRACT

The invention relates to a roman blind with a flexible curtain web, which is pleated at right angles to its extension direction, and with at least one gathering band which is fixed on one side of the web, extends in the direction of the gathering movement and comprises at least one gathering cord and regularly spaced loops for guiding a drawing cord. According to the invention, the gathering band (12) also extends along the pleated portions (pleats 22) of the web, whereas the gathering cord (18 or 20) at the gathering band (12) is guided directly from one portion of the web situated before a pleat (22) to a portion of the web (10) following this pleat (22).

5 Claims, 2 Drawing Sheets

FIG.1
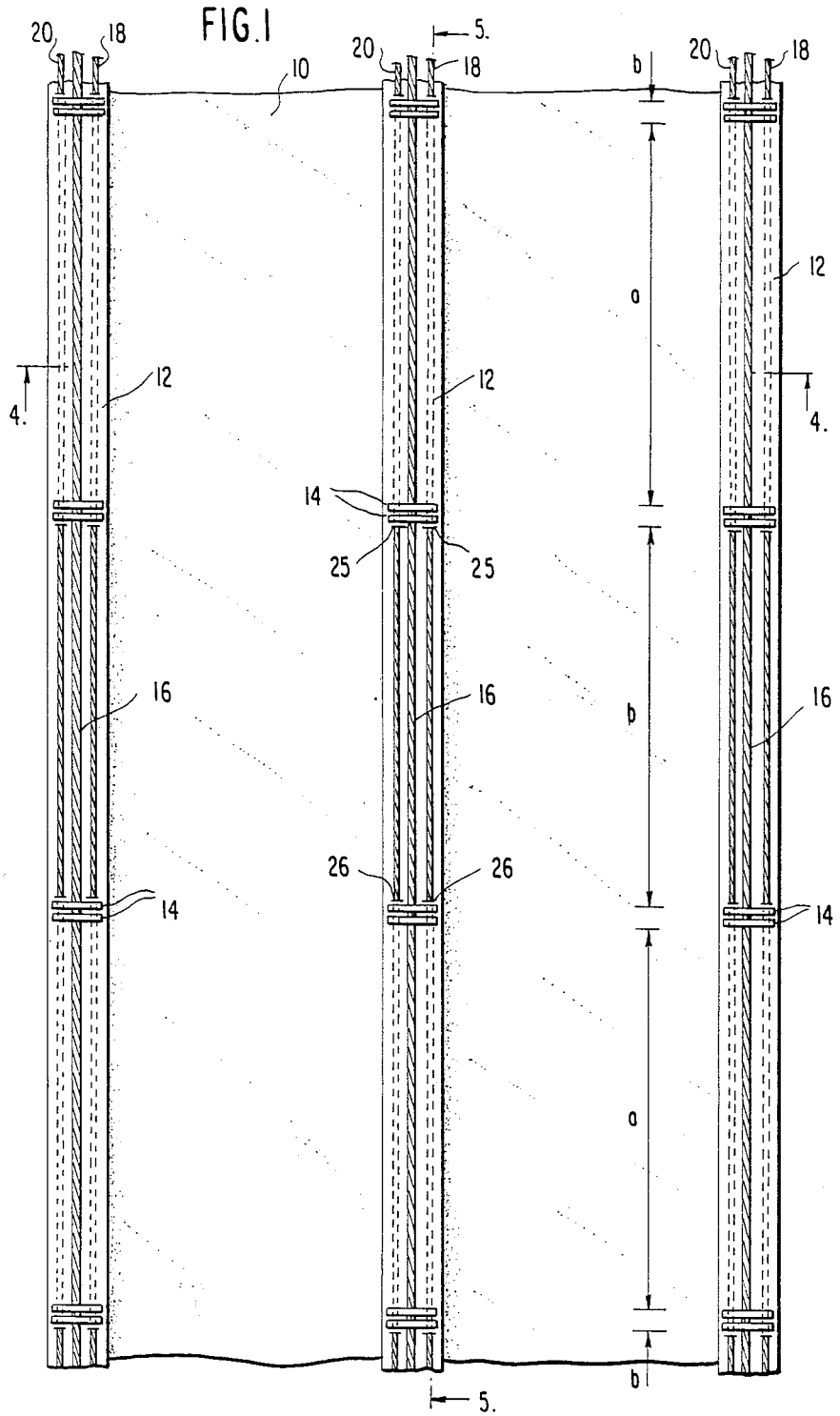
FIG.5
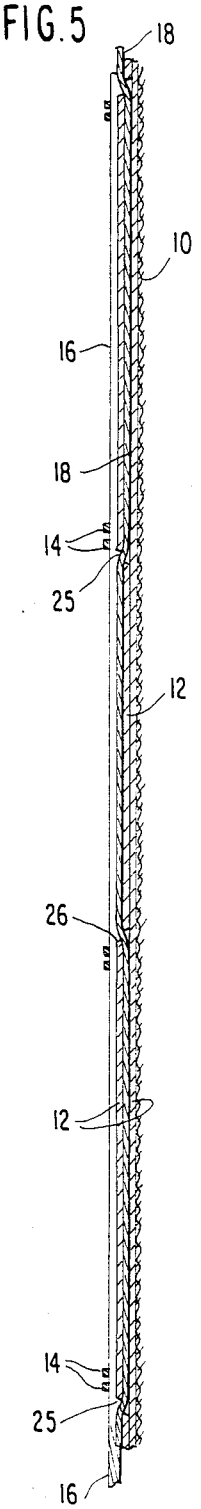
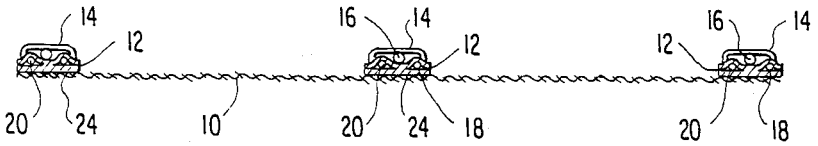
FIG.4

ROMAN BLIND

This is a continuation application of Ser. No. 666,808 filed Oct. 31, 1984, now abandoned.

FIELD OF THE INVENTION

The invention concerns a roman blind with a flexible curtain web which is pleated at right angles to its extension direction, and with at least one gathering band which is fixed on one side of the web, extends in the direction of the gathering movement and comprises at least one gathering cord as well as regularly spaced loops for guiding a drawing cord.

BACKGROUND OF THE INVENTION

A roman blind is a window decoration curtain which is normally gathered in the vertical direction. Roman blinds with their web portionally pleated at right angles to their extension direction are well known in the art.

When manufacturing such roman blinds, first the distances for the pleats of its curtain web are defined by measuring, then the web has to be pleated and the pleats are to be tacked. Then several gathering bands are usually attached to the web in longitudinal direction and parallel to each other, thereby fixing the pleats in the web.

Because of the multitude of operations which were necessary up until now for defining the pleats of the curtain web and to fix them, the manufacture of such roman blinds is complicated and expensive.

It is the object of the present invention to simplify the manufacture of such roman blinds.

SUMMARY OF THE INVENTION

This object is achieved, according to the invention, by a roman blind, the gathering of which also extends along the pleated portions of the web, whereas the gathering cord on the gathering band is guided directly from a portion of the web situated before a pleat to a portion of the web following this pleat.

Due to the inventive measures, the definition of the portions, in which the pleats are to be made, the measuring of the depths of the pleats, the pleating itself and the tacking of the pleats becomes superfluous. The gathering band is continuously applied to the straight curtain web. The pleats of the web inevitably result from the gathering of the gathering band via the gathering cord.

When gathering the gathering band, the automatic pleating of the curtain web results from the fact that the gathering cord is disposed inside the gathering band for certain first length portions and outside thereof for second portions, so that when the gathering cord is pulled, those portions of the gathering band on which the gathering cord is loosely disposed, can bulge, while two first portions which are separated by one second portion, forcibly join each other.

By a corresponding pull operation on the gathering cord, the desired pleats are created over the whole curtain web.

The loops guiding the drawing cord are placed in said first portions of the gathering band in which the gathering cord is guided. In a preferred embodiment of the invention, two loops of the gathering band are immediately adjacent to each other respectively before and after a pleat of the curtain.

An embodiment of a roman blind according to the invention is shown in the drawing.

BRIEF DESCRIPTION OF THE DRAWINGS

FIG. 1 shows a back view of the blind in the lowered state before pleating.

FIG. 4 shows a sectional view of the roman blind according to FIGS. 1 to 3.

FIG. 5 shows a longitudinal view along line 5—5 in FIG. 1.

DESCRIPTION OF THE PREFERRED EMBODIMENT

Figure 2:
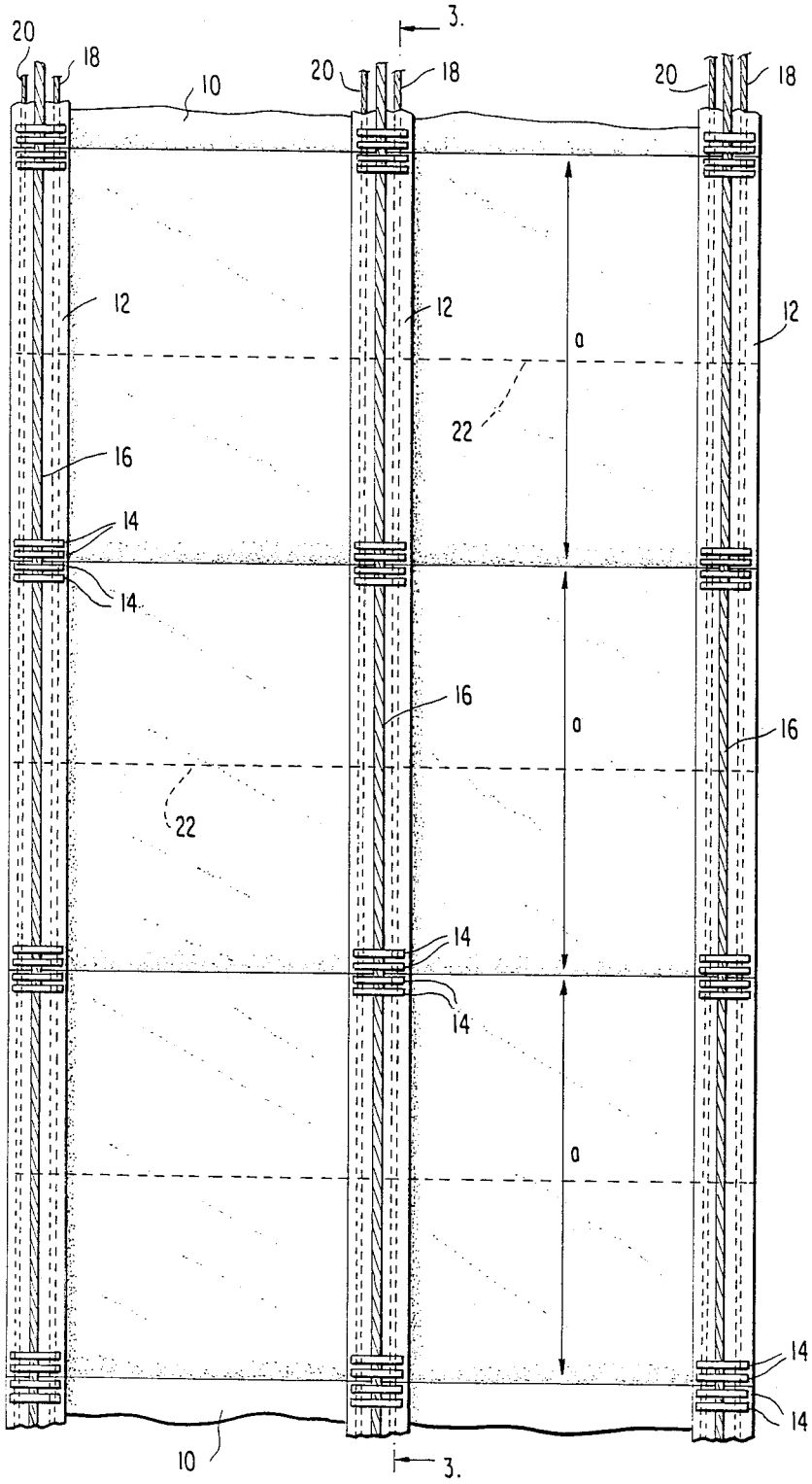
FIG. 2 shows a view according to FIG. 1 of the blind in the pleated state.

The roman blind shown in the drawings is composed of a flexible, for example rectangular curtain web 10, which can be made of woven fabric, a suitable foil or a coated fabric. On one of the web sides, preferably the backside, the curtain web is provided with three parallel gathering bands 12, which extend in the direction of the gathering movement, which is the vertical direction.

Each gathering band is provided with a series of regularly spaced loops 14, in which a drawing cord 16 is movably guided.

By pulling on the drawing cords 16, the curtain web 10 can be pulled upwards. Thereby, successive portions of the web, which are disposed below a loop 14, are drawn upwards.

Figure 3:
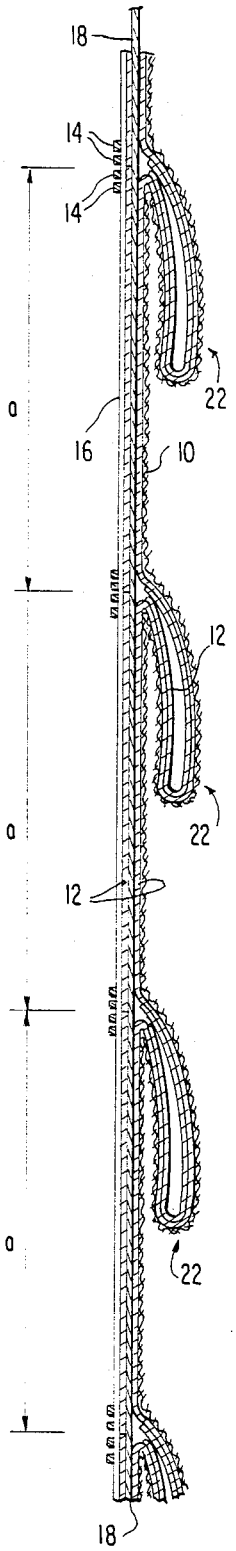
FIG. 3 shows a cut through a pleated portion of the blind along the line 3—3 of FIG. 2.

In a preferred embodiment of the invention, the gathering bands 12 are each supplied with a pair of gathering cords 18 and 20, which extend parallel to each other in the longitudinal direction. As can be seen in FIG. 1, these gathering cords are guided in first portions a inside each gathering band, while they emerge from the gathering bands 12, at 25 and lie loosely on the gathering bands in second portions b, further entering the bands 12 at 26 at the other end of portions b. When the gathering cords 18, 20 are pulled, the second portions b of the gathering band bulge to form pleats 22 according to FIG. 3, while the gathering cords 18, 20 remain in the straight disposition. The pleats 22 of the curtain web 10 at a right angle are thus achieved automatically, the portions a approach each other until they lie beside each other, so that the gathering cords are tightly guided over the pleats and in the portions a of the gathering band following one another.

Due to the distinction between portions a and b as defined above, it is no longer necessary to measure the pleat lengths, to pleat the web and to tack the pleats, as the portions a and b are conceived such that their length and the desired distances of the particular curtain web pleats appear automatically.

As shown in FIG. 1, the drawing cord loops 14 are disposed on the gathering bands 12 in a way that they are respectively placed at the end of the gathering band portions a, over which the gathering cords are loosely guided. When gathering the gathering bands for pleating the curtain web, this necessarily results in the fact that the loops 14 approach each other and are finally disposed one directly beside the other. In the roman blind according to the invention, the gathering bands 12 are thus disposed on one side of the curtain web 10 while the curtain web pleats 22 are on the other side of the curtain. In the pleated state of the curtain, the web portions a, FIG. 2, in which the gathering cords 18, 20 run inside the gathering bands 12, succeed each other directly, as the web portions b have become pleats 22.

The invention makes it possible, according to the mutual coordination of the portions a and b of the gathering band, to adjust the distances of the curtain web pleats as well as the depth of the pleats.

Within the frame of the invention, several pleated portions b can follow each other immediately, so that a multiple pleat results.

In the described roman blind, the gathering bands 12 can be fixed by sewing or by gluing, the latter by means of an adhesive coating 24. Such an adhesive coating can be constituted by a plastic layer which can be activated by means of heat and pressure, for example, through a heated steam pressing iron. In this case, the layer is plastified and penetrates into the structure of the curtain web 10. Thus, a homogeneous connection between the curtain web and the gathering band is obtained.

I claim:

1. A roman blind with a flexible curtain web which may be gathered, thereby forming pleats at right angles to its extent and direction, and having at least one gathering band which is fixed on one side of the web, and extends in the direction of the gathering movement and comprising at least one drawing cord and regularly spaced loops (14) fixed to the gathering band for guiding said at least one drawing cord, the improvement comprising:

at least one gathering cord, wherein the gathering band (12) has at least one longitudinal sleeve and extends along the complete length of the web for forming pleats (22), and said gathering band includes means causing said at least one gathering cord over alternating portions (a) of the web situated before and after a pleat (22) to lie inside said at least one sleeve in said gathering and gathering band (12) to directly guide the at least one gathering cord over said alternating portions (a) of the band and causing said gathering cord to lie adjacent the side of said gathering band opposite said web over the portions (b) of said web between said alternating portions (a) of the web (10), such that by drawing said at least one gathering cord, said alternating portions of said web are moved into edge abutting position and said portions of said web between said alternating portions are folded into said pleats (22) on the other side of said web opposite that carrying said gathering band.

2. A roman blind according to claim 1, wherein said loops (14) are fixed to said gathering band at positions adjacent each end of each alternating portion (a) of the web thereby forming a curtain pleat (22) and said at least one drawing cord passes through said loops such that upon pulling said at least one gathering cord, pleats (22) are formed and two loops (14) of the gathering band (12) are positioned immediately adjacent to each other at each pleat position.

3. A roman blind according to claim 1, wherein the at least one gathering band (12) is sewn on said web.

4. A roman blind according to claim 1, wherein the at least one gathering band (12) is fixed to the curtain web (10) by an adhesive layer activated by pressure and heat.

5. A roman blind according to claim 1, wherein said at least one gathering band comprises at least two, laterally spaced, parallel gathering bands (12) fixed on the same side of the curtain web and wherein said web portions (b) located between said alternate portions (a) are all of the same length such that said pleats (22) are of uniform size on the side of said curtain web opposite that carrying said gathering bands.

* * * * *